US006296258B2

(12) United States Patent
Higgins et al.

(10) Patent No.: US 6,296,258 B2
(45) **Date of Patent: *Oct. 2, 2001**

(54) SNOWBOARD SHOCK-ABSORBING APPARATUS

(75) Inventors: Michael Timothy Higgins, Fresno; Robert John Caputo, Santa Clara, both of CA (US)

(73) Assignee: Polar Design, San Jose, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/108,077

(22) Filed: Jun. 30, 1998

(51) Int. Cl.[7] ..... A63C 9/081
(52) U.S. Cl. ..... 280/14.22; 280/613
(58) Field of Search ..... 280/14.22, 623, 280/624, 11.2, 11.3, 613, 625, 633, 634, 638; 248/615, 581, 624, 638; 267/140, 140.11

(56) References Cited

U.S. PATENT DOCUMENTS

| | | | | |
|---|---|---|---|---|
| 1,830,058 | * | 11/1931 | Helmond | 248/581 |
| 2,597,800 | * | 5/1952 | Hussman | 248/581 |
| 2,704,663 | * | 3/1955 | Blake | 248/615 |
| 4,741,550 | * | 5/1988 | Dennis | 280/618 |
| 5,188,386 | * | 2/1993 | Schweizer | 280/14.2 |
| 5,227,956 | * | 7/1993 | Johnson et al. | 248/624 |
| 5,755,046 | * | 5/1998 | Dodge | 280/613 |
| 5,897,128 | * | 4/1999 | Mckenzie et al. | 280/607 |
| 5,913,530 | * | 6/1999 | Berger et al. | 280/607 |
| 5,947,488 | * | 9/1999 | Gorza et al. | 280/14.2 |

OTHER PUBLICATIONS

"Clicker Binding Manual," K2 Snowboards, Vashon Island, WA; 1997–98.

Pauporté, et al.; "Snowboard Binding Manual," Switch Manufacturing, San Francisco, CA; 1997.

Snoshox® Promotional Brochure, Incline, Inc., Portland, OR; 1998–99.

* cited by examiner

*Primary Examiner*—Lanna Mai
*Assistant Examiner*—Hau Phan
(74) *Attorney, Agent, or Firm*—Thelen Reid & Priest LLP; David B. Ritchie

(57) ABSTRACT

The present invention is directed to a shock-absorbing apparatus for use with a variety of snowboards and binding systems. The apparatus includes a binding platform, at least one bearing assembly coupled to the binding platform and the snowboard, and at least one biasing assembly coupled to the platform and the snowboard. Each bearing assembly and biasing assembly are responsive to mechanical energy encountered by the binding platform or the snowboard during use by enabling the binding platform to swivel/pivot from or move along an axis that intersects a top surface of the snowboard.

16 Claims, 7 Drawing Sheets

SNOWBOARD SHOCK-ABSORBING APPARATUS

BACKGROUND OF THE INVENTION

1. Field of the Invention

The present invention relates to a shock-absorbing apparatus which is compatible with a variety of snowboards and binding systems.

2. Background

Snowboarding as a winter activity has seen tremendous growth in recent years. It is an activity that can be enjoyed almost anywhere so long as there is suitable terrain, such as a snow/ice covered slope, mountainside, or sculpted terrain (such as half-pipe embankments), or a sand dune having a sufficient grade. A snowboarder is attached to an approximately flat board ("snowboard") which has an approximately flat bottom that allows it to slide down the terrain. The snowboard also has a front end ("tip"), back end ("tail"), a top surface, a bottom surface, and two sides which are typically bounded by parallel bottom side edges. The front end and back end may be symmetrically shaped. The front and back ends are relative terms—the front end is the end closest to the direction of travel, while the back end is the end farthest from the direction of travel. The distance between the two sides defines the width of the snowboard with the width much shorter than the length of the snowboard, giving the snowboard a high length to width ratio.

A rider is coupled to the snowboard through an attachment system that includes a pair of bindings and a pair of boots. The orientation of the bindings typically provide two stances although the stances may be modified by the rider depending on the type of terrain and activity anticipated. The first stance, known in the snowboarder vernacular as a "regular foot" stance, includes having the snowboarder ride with the left foot placed closest to the tip or to the direction of travel. The second stance is sometimes referred to as the "goofy foot" stance and includes having the right foot placed closest to the tip or to the direction of travel. When using either one of two above stances, the terms, "toeside" edge or "heelside" edge, are sometimes used to refer to one of the two parallel bottom side edges. The "toeside" edge refers to the side edge nearest to the snowboarder's toes and the heelside edge refers to the side edge nearest to the snowboarder's heels. The bindings are attached to the snowboard and typically remain within a fixed orientation during use. The bindings are attached near the top surface of the snowboard, minimizing the amount of spacing between a rider's boots and the top surface of the snowboard.

The snowboard is designed to provide various levels of flexibility, depending on the type of terrain or activity anticipated by the rider. A stiff flexing board gives the rider greater "feel" or feedback than does a softer flexing board, enabling the rider to cut better turns. A stiffer board also permits the rider to induce greater stress on the board, such as when racing, without the board distorting greatly, enhancing turning accuracy and responsiveness of the board. However, both types of snowboards tend to transfer mechanical energy, i.e., shocks, vibration and jitter caused by use and which vary depending on terrain or activity, are directly transferred to the rider, increasing the rider's level of fatigue and discomfort.

Accordingly, a need exists for a shock-absorbing apparatus that can absorb mechanical energy applied to a snowboard or to a rider, while remaining compatible with existing snowboards, bindings, and boots.

Moreover, a need exists for a shock-absorbing apparatus that can absorb mechanical energy applied to a snowboard or to a rider while enhancing a rider's ability to cut turns on the snowboard.

SUMMARY OF THE INVENTION

The present invention is directed to a shock-absorbing apparatus for use with a variety of snowboards and binding systems. The apparatus includes a binding platform, at least one bearing assembly coupled to the binding platform and the snowboard, and at least one biasing assembly coupled to the platform and the snowboard. Each bearing assembly and biasing assembly are responsive to mechanical energy encountered by the binding platform or the snowboard during use by enabling the binding platform to swivel/pivot from or move along an axis intersecting a top surface of the snowboard.

DETAILED DESCRIPTION OF A PRESENTLY PREFERRED EMBODIMENT

Figure 1:
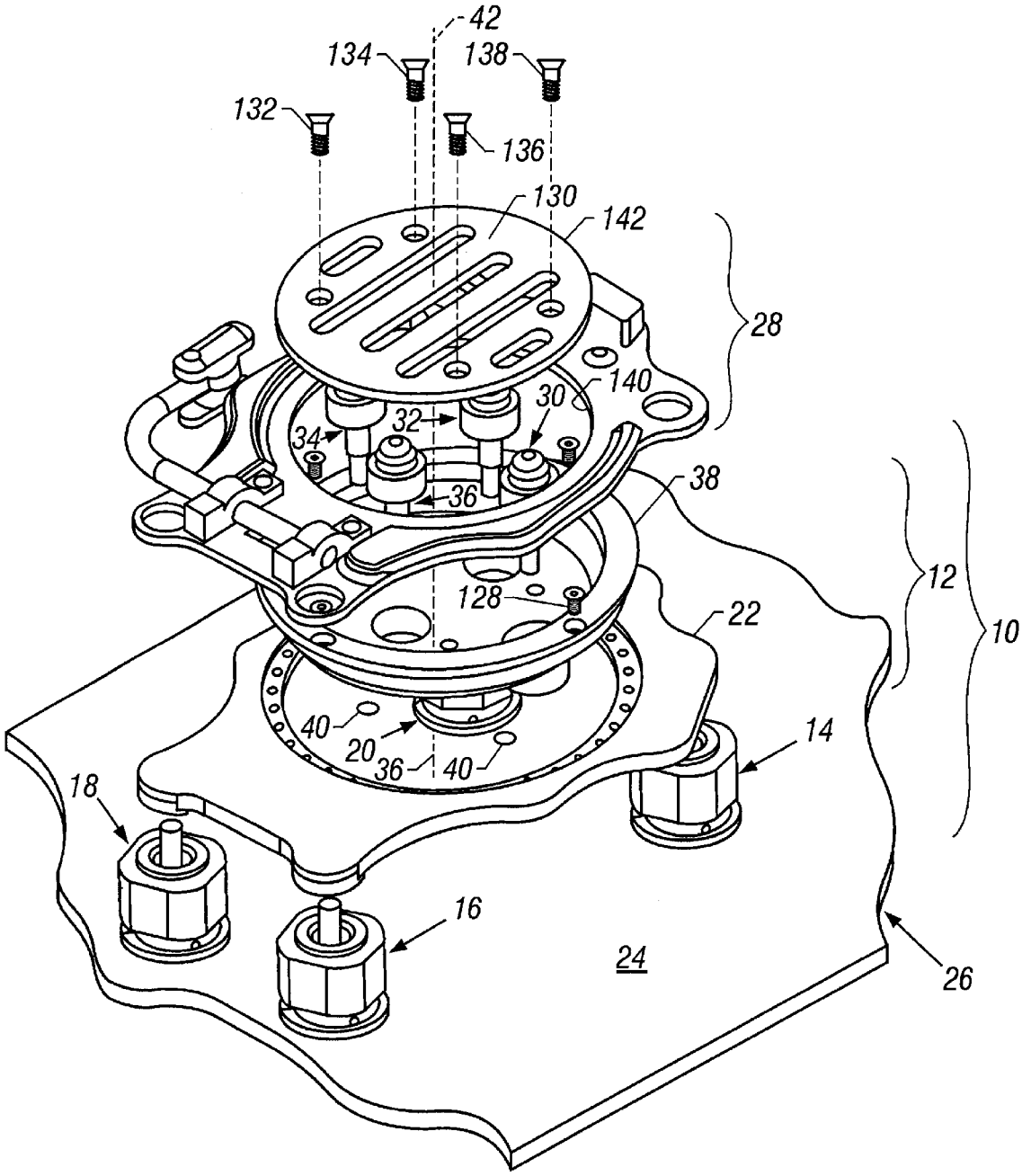
FIG. 1 is an exploded view in perspective of a snowboard shock-absorbing apparatus mated to fit to a step-in binding and a snowboard in accordance with a presently preferred embodiment of the present invention.
Figure 2:
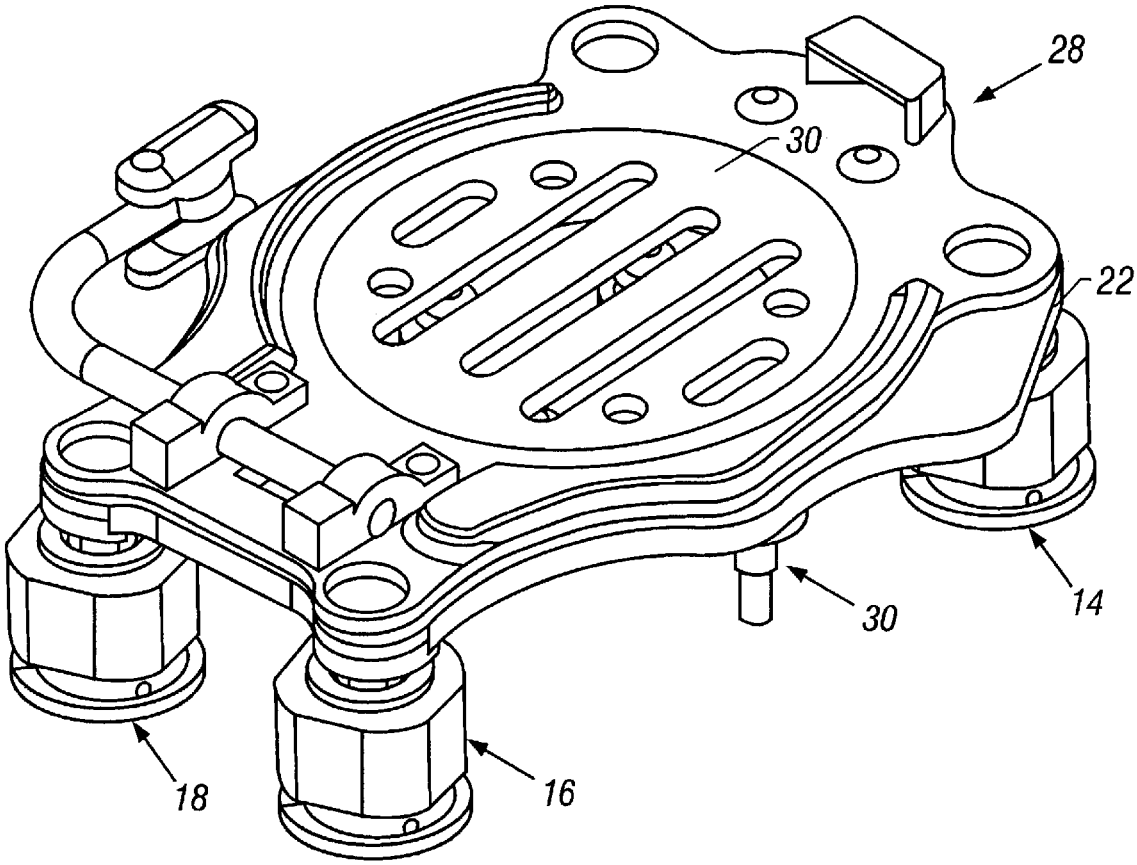
FIG. 2 is a perspective of the snowboard shock-absorbing apparatus shown in FIG. 1 in accordance with a presently preferred embodiment of the present invention.
Figure 3A:
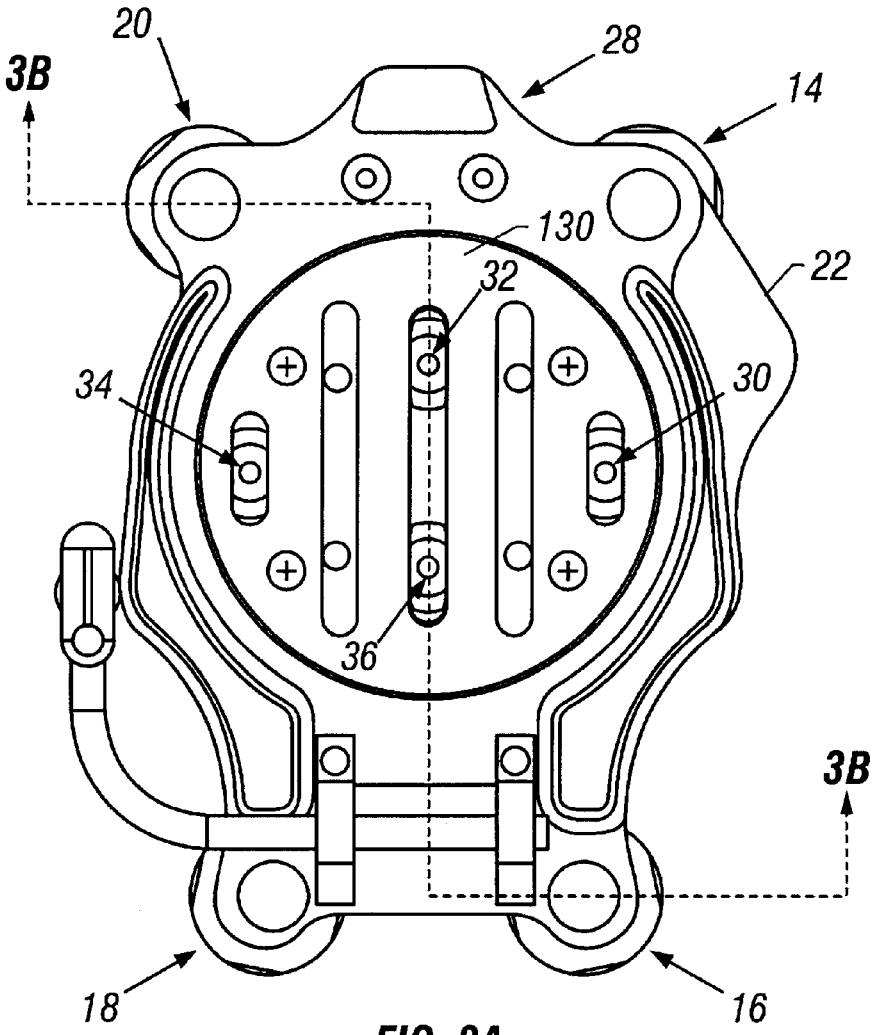
FIG. 3A is a top view of the snowboard shock-absorbing apparatus shown in FIG. 1 in accordance with a presently preferred embodiment of the present invention.
Figure 3B:
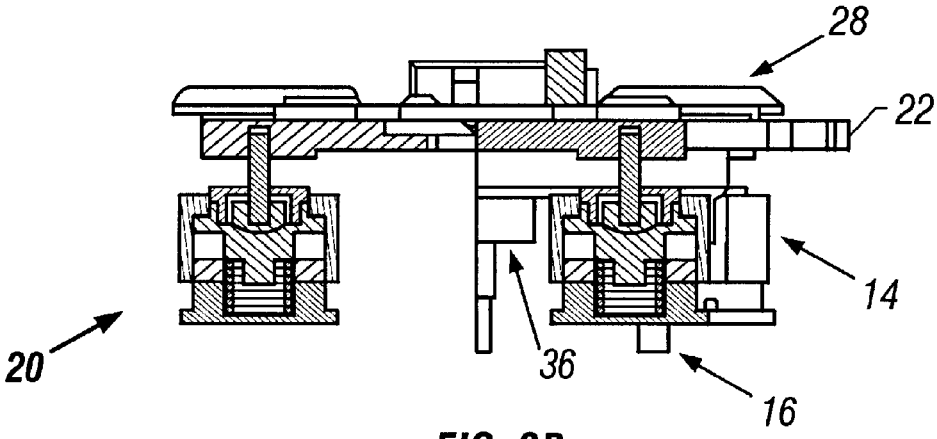
FIG. 3B is a sectional view at 3B—3B of the snowboard shock-absorbing apparatus shown in FIG. 3A in accordance with a presently preferred embodiment of the present invention.

Those of ordinary skill in the art will realize that the following description of the present invention is illustrative only and is not intended to be in any way limiting. Other embodiments of the invention will readily suggest themselves to such skilled persons from an examination of the within disclosure.

Referring to FIGS. 1–3B, a snowboard shock-absorbing apparatus 10 is shown having a binding platform 12 and a four biasing assemblies 14, 16, 18, and 20. Biasing assemblies 14, 16, 18, and 20 are coupled between a plate 22 and a top surface 24 of a snowboard 26. Binding platform 12 is shown coupled to snowboard 26 and a step-in binding 28 through four bearing assemblies 30, 32, 34, and 36 which attach a hub 38 of platform 12 to a set of apertures 40 defined in a pattern in snowboard 26.

In accordance with a presently preferred embodiment of the present invention, bearing assemblies 30, 32, 34, and 36 permit platform 12 (and thus step-in binding 28 and its attached user) to pivot or swivel from and move along axis 42, while also providing a rugged construction design which will enable biasing assemblies 14 through 20 to absorb the shocks and bumps ("mechanical energy") encountered by apparatus 10 during use. Axis 42 is any axis which intersects top surface 24 although in the preferred embodiment of the present invention, axis 42 intersects top surface 24 at an approximately perpendicular angle. Besides providing ruggedness, bearing assemblies 30, 32, 34, and 36 also allow platform 10 to be mounted in a standard hole pattern found in many common snowboards, adding versatility to apparatus 10.

Figure 4A:
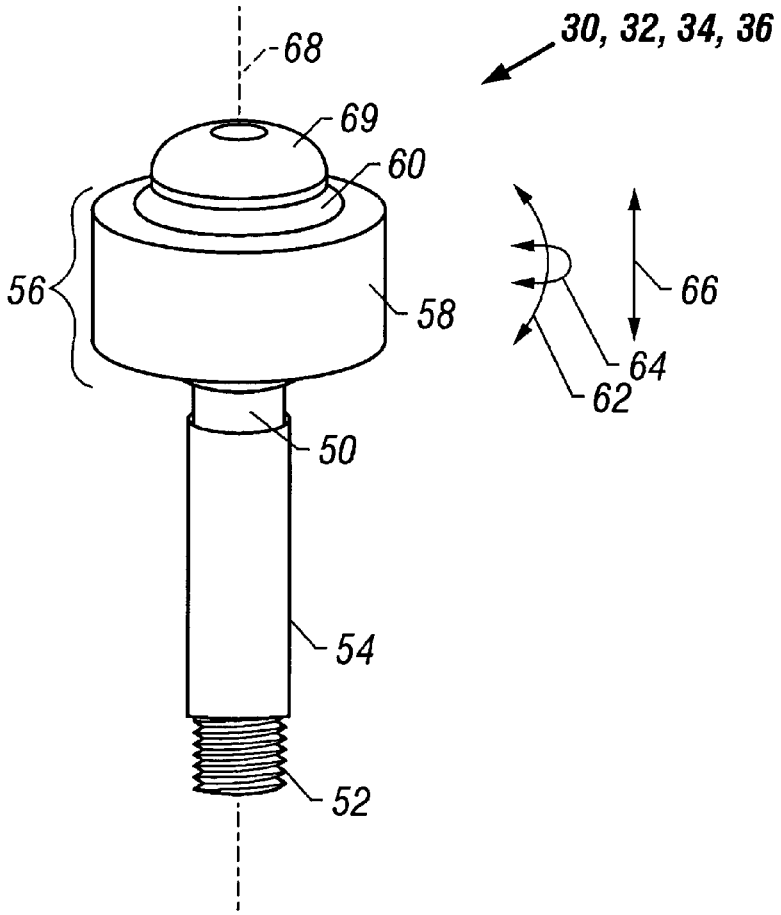
FIG. 4A is a perspective view of a bearing assembly in accordance with a presently preferred embodiment of the present invention.
Figure 4B:
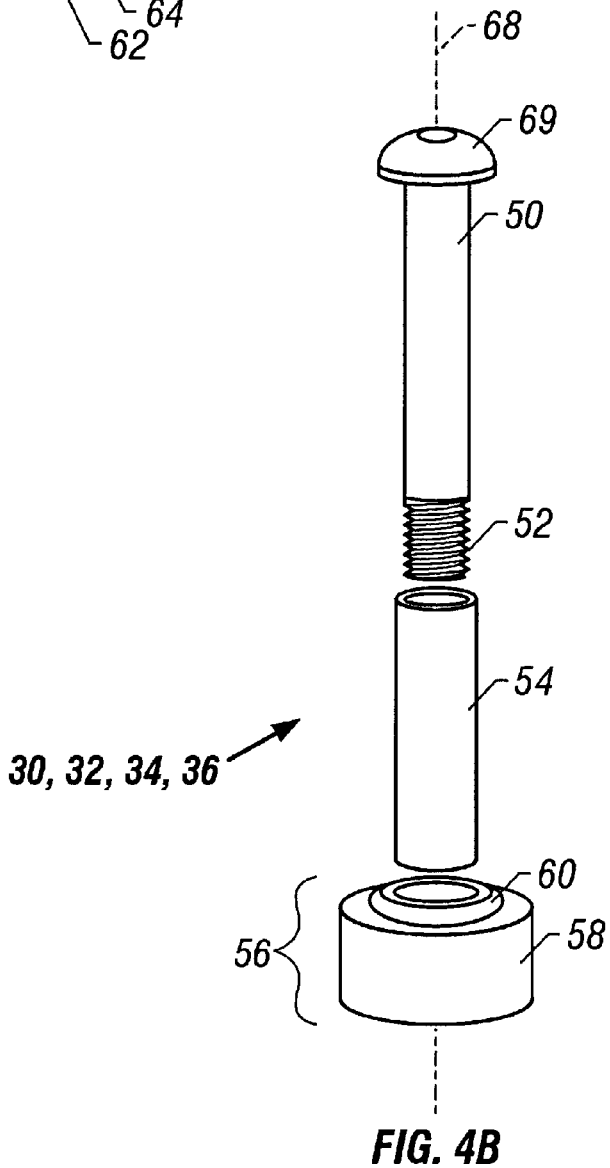
FIG. 4B is an exploded view of the bearing assembly shown in FIG. 4A in accordance with a presently preferred embodiment of the present invention.

Referring now to FIGS. 4A and 4B, bearing assemblies 30, 32, 34, and 36 each include a bolt 50 having a threaded portion 52, a stand-off 54, and a spherical bearing 56. Spherical bearing 56 includes a sleeve 58 and a sphere 60 with a cylindrical cavity for which bolt 50 is placed, as shown. This enables sleeve 58 to swivel 62, rotate 64, and/or slide 66 along axis 68. Those of ordinary skill in the art will recognize the amount of movement along axis 68 is limited by a head portion 69 of bolt 50 and standoff 54. Spherical bearings are known to those of ordinary skill in the art and are available from W.M. Berg, Inc., 499 Ocean Avenue of East Rockaway, N.Y. Each bearing assembly used is attached to platform 12 at sleeve 58 and to snowboard 26 at threaded portion 52. This permits platform 12 and snowboard 26 to swivel and move or slide along axis 42 (see FIG. 1).

In accordance with an alternative embodiment of the present invention, bearing assemblies 30, 32, 34, and 36 may be arranged to fit with non-standard hole patterns, such as that found on the Burton snowboard.

The number of biasing assemblies and bearing assemblies used and the pattern used to position the assemblies in the presently preferred embodiment are not intended to be limiting in any way. Other configurations may be used that are within the scope and spirit of the herein disclosure and which may be evident to those of ordinary skill in the art.

Figure 5A:
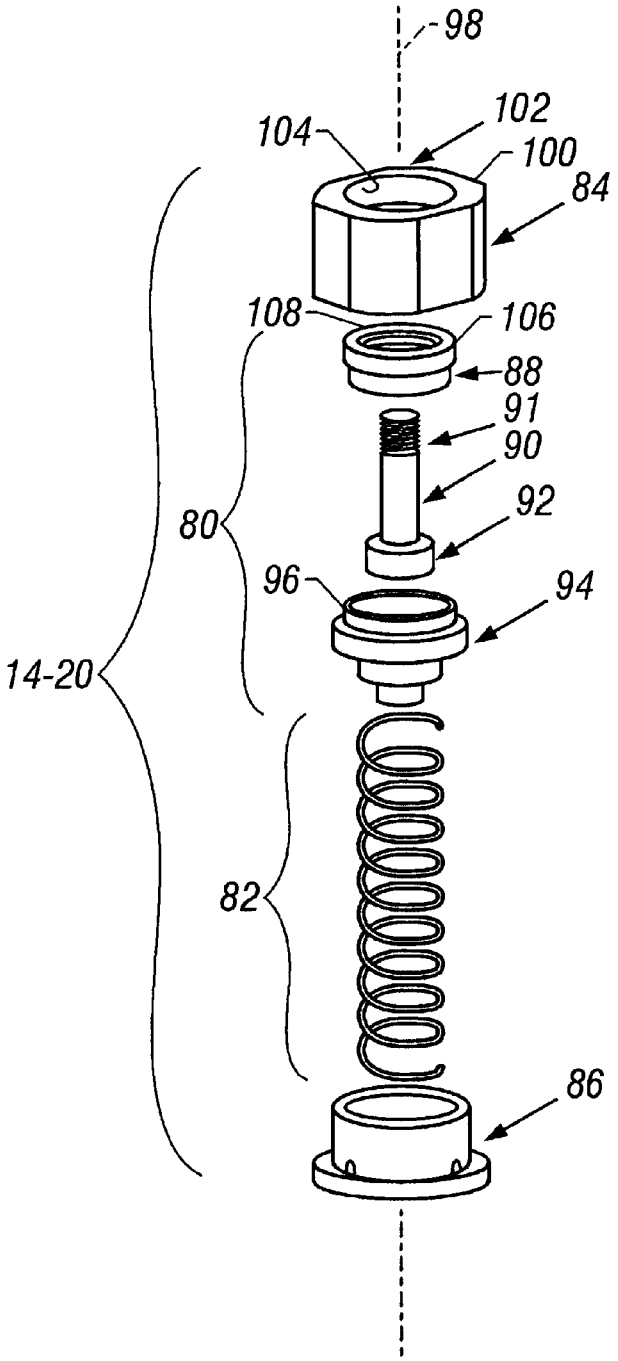
FIG. 5A is an exploded view in perspective of a biasing assembly in accordance with a presently preferred embodiment of the present invention.

Referring to FIG. 5A, biasing assemblies 14, 16, 18, and 20 each include a swivel assembly 80 and a biasing element 82 which are bounded by a top portion 84 and a bottom portion 86. Top portion 84 and bottom portion 86 are sometimes referred to as a retainer and foot, respectively. Swivel assembly 80 includes a threaded lid 88, a coupler 90, and a socket 94 having a threaded outside surface 96 configured to receive lid 88.

Biasing element 82 may be any type of biasing element that can provide biasing along an axis 98 although in accordance with a presently preferred embodiment of the present invention biasing element 82 is a spiral spring. Spiral springs are known to those of ordinary skill in the art and are available from Smalley Steel Ring Company of Wheeling, Ill. The spiral spring provides full compression at 52 pounds of force and is formed using a wire having a rectangular-like or approximately flat cross-section (not shown).

Figure 5B:
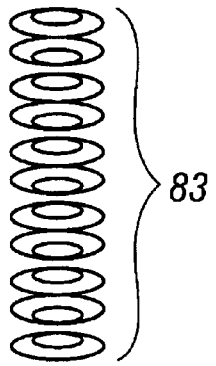
FIG. 5B is a perspective view of a biasing element for use with a biasing assembly in accordance with an alternative embodiment of the present invention.
Figure 6:
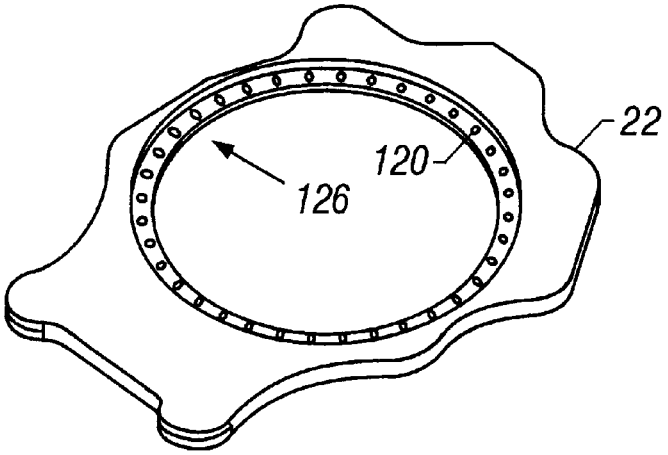
FIG. 6 is a perspective view of a plate forming part of a binding platform in accordance with a presently preferred embodiment of the present invention.

FIG. 5B is a perspective view of a biasing element 83 in accordance with an alternative embodiment of the present invention. Biasing element 83 includes at least eleven disc springs providing full compression at 52 pounds. Disc springs are known by those of ordinary skill in the art and are sometimes referred to as "Belleville springs." The disc springs described herein are available from Century Spring Corporation of Los Angeles, Calif.

The use of a spiral spring or disc springs as a biasing element is not intended to be limiting in any way but are illustrative of the type of biasing elements that may be used in the present invention. Other types of springs may be used without departing from the scope or spirit of the present invention.

The number of springs used is not intended to be limiting in any way. Those of ordinary skill in the art will recognize from the herein disclosure that any number of springs may be used, depending on the type of springs used and the size of biasing assembly used to house the springs, among other things.

Figure 7A:
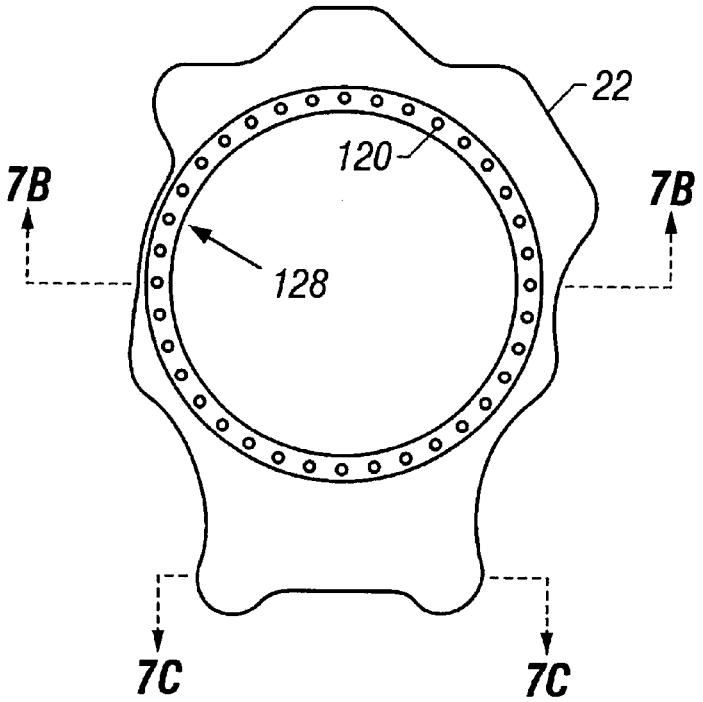
FIG. 7A is a top view of the plate shown in FIG. 6 forming part in accordance with a presently preferred embodiment of the present invention.
Figure 7B:
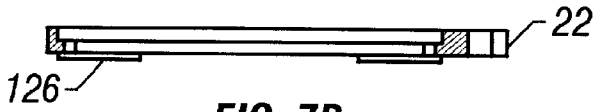
FIG. 7B is a sectional view at 7B—7B of the plate shown in FIG. 7A in accordance with a presently preferred embodiment of the present invention.
Figure 7C:
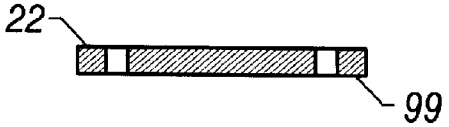
FIG. 7C is a sectional view at 7C—7C of the plate shown in FIG. 7A in accordance with a presently preferred embodiment of the present invention.
Figure 8:
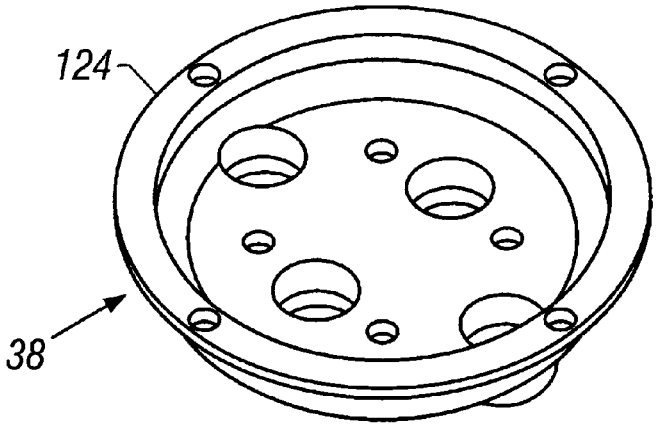
FIG. 8 is a perspective view of a hub forming part of a binding platform in accordance with a presently preferred embodiment of the present invention.
Figure 9A:
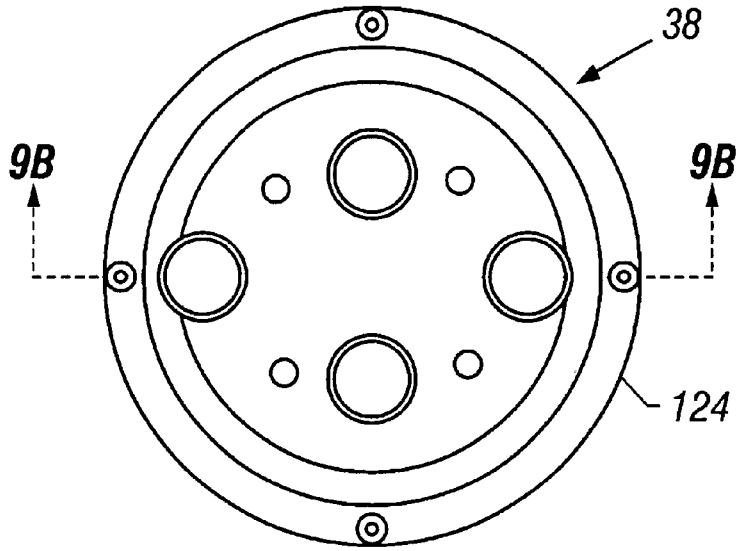
FIG. 9A is a top view of the hub in accordance with a presently preferred embodiment of the present invention.
Figure 9B:
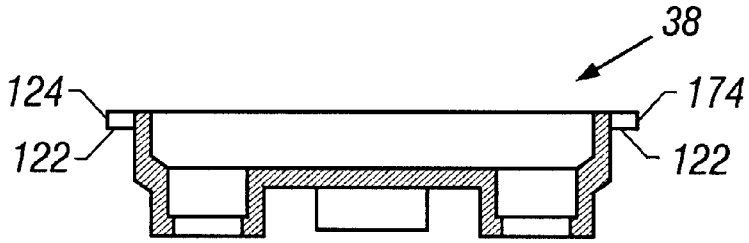
FIG. 9B is a sectional view at 9B—9B of the hub shown in FIG. 7A in accordance with a presently preferred embodiment of the present invention.

When coupled to plate 22, biasing assemblies 14, 16, 18, and 20 provide shock absorbing properties to platform 12 (and hence to a rider attached to platform 12 via binding 28). Each biasing assembly is coupled to a bottom surface 99 (see FIG. 7C) of plate 22 through the use of coupler 90 having a first end 91 and a swivel portion 92. Coupler 90 is fixed to plate 22 at first end 91. When received by socket 94, swivel portion 92 enables the biasing assembly to absorb mechanical energy transferred from snowboard 26 through biasing element 82 at angles offset from axis 98. When combined with bearing assemblies 30, 32, 34, and 36 in FIG. 1, each swivel portion and socket with the bearing assemblies permit platform 12 to swivel at angles offset from axis 42.

In accordance with a preferred embodiment of the present invention, coupler 90 is a button head screw (not shown) having a button head portion and a threaded portion. The button head portion forms swivel portion 92 of coupler 90 and the threaded portion forns first end 91. The use of a button head screw is not intended to be limiting in any way. Other embodiments may be used such as a separate set screw (not shown) having a threaded first end and threaded second end and a separate swivel portion having a threaded portion for receiving the threaded second end of the separate screw. The first end of the set screw is fixed to plate 22 and the second end is fixed to the threaded portion of swivel portion 92.

Top portion 84 may have an inner threaded surface and bottom portion 86 may have an outer threaded surface top portion 84. Both threaded surfaces are sized to interlock with each other so that top portion 84 can be "screwed-on" to bottom portion 86. This not only enables top portion 84 and bottom portion 86 to retain socket 94 and biasing element 82, but provides a biasing element adjustment feature.

Specifically, top portion 84 has a first end 100 having an aperture 102 having a size defined by an inner edge 104. Lid 88 has top end 106 having a size defined by outer edge 108. The position along axis 98 of first end 100 determines the maximum travel of lid 88 (and hence the maximum travel of biasing element 82 along axis 98) and the amount of preset bias provided by biasing element 82. Thus, maximum travel and the amount of present bias provided by biasing element 82 may be selected simply by increasing or decreasing the amount top portion 84 is screwed onto bottom portion 86.

When used with bearing assemblies 30, 32, 34, and 36, biasing assemblies 14, 16, 18, and 20 enable binding platform 12 to not only swivel (as discussed above) and/or slide along axis 42 in a damped manner in response to mechanical energy, such as jolts, bumps, and vibration, encountered during use. This provides an independent suspension feature to platform 12 since snowboard 26 can move along axis 42 (relative to platform 12) and do so even though its top surface 24 may be in a plane which is not perpendicular to axis 42.

This ability by platform 12 to swivel and/or slide along axis 42 by snowboard 26 through bearing assemblies 30, 32, 34, and 36, while damped by biasing assemblies 14, 16, 18, and 20 results in a smoother ride and precise handling characteristics for the user. The user's position along a plane intersecting axis 42, such as the plane provided by binding platform 28, does not change even though snowboard 26 may move along and/or swivel about axis 42 during use. This gives the user better control of snowboard 26, such as edge control, and better feedback as to the terrain traveled upon because the user's sense of position relative to the plane intersecting axis 42 is not unnecessarily affected by the shock absorbing movements of bearing assemblies 30, 32, 34, and 36 and biasing assemblies 16, 18, and 20.

In addition, binding platform 12, bearing assemblies 30, 32, 34, and 36, and biasing assemblies 14, 16, 18, and 20 creates a raised stance for the user. This eliminates the possibility of toe or heel drag during use, such as making turns in soft snow or rough terrain. The raised stance also enhances the ability of a user to transfer more power to the edges during turns.

In FIGS. 1–3B, since hub 38 is coupled to bearing assemblies 30, 32, 34, and 36, hub remains rotationally fixed relative to axis 42. However, this aspect of the present invention is not intended to be in any way limiting. A single bearing assembly may be positioned along vertical axis 42, permitting hub 38 to not only swivel and a move along axis 42 but also to rotate about axis 42. However, to ensure ruggedness and dependability, more than one bearing assembly is used in the presently preferred embodiment of the present invention.

Referring now to FIGS. 6–9B, plate 22 includes a surface 120 which is configured to receive a flange 122 forming an outer edge 124 for hub 38. This permits plate 12 to rotate about axis 42 (see FIG. 1) even though hub 38 is rotationally fixed by bearing assemblies 30, 32, 34, and 36. Both surface 120 and flange 122 have a plurality of apertures 126 which are shaped to receive at least one screw, such as screw 128 in FIG. 1. This permits plate 22 to be rotated about axis 42 to a selected position and then set at that position by screw 128. Any number of screws may be used although at least four screws are used in a presently preferred embodiment of the present invention.

The use of a hub and plate in the manner described above is not intended to be limiting in any way. Those of ordinary skill in the art will recognize that binding platform 12 may be made into a single piece, more than two pieces, or any other number of pieces without departing from the inventive concepts described herein. For example, platform 12 may be integrally formed into a single piece which does not have a plate portion which may be selected to have a position about axis 42 but is fixed to a hub portion which is in turn, fixed to snowboard 26. The user's stance may be adjusted by rotating step-in binding 28 to a selected position and then held in that position by attaching binding disc 130 (see FIG. 1) to hub 38 using screws 132, 134, 136 and 138 to attach to a hole pattern formed on hub 38. The hole pattern may be a standard hole pattern which matches the hole patterns on binding disc 130, although other hole patterns may be used, such as a hole pattern found on a Burton binding™.

Those of ordinary skill in the art will recognize that step-in binding 28 includes teeth (not shown) which form edge 140 and binding disc 130 also includes teeth (not shown) at its outer edge 142. This enables step-in binding 128 to be interlocked with binding disc 130 when binding disc 130 is attached using screws 132, 134, 136, and 138 to threaded holes on hub 38. In accordance with a preferred embodiment of the present invention, screws 132, 134, 136, and 138 are flat head screws although any type of screw or fastener may be used without departing from the scope or spirit of the herein disclosure.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. A shock-absorbing apparatus for coupling a binding to a snowboard, the apparatus comprising:

a plate, said plate adapted to have the binding firmly attached thereto;

a bearing assembly coupling said plate to the snowboard, said bearing assembly including a threaded portion for engaging the snowboard and a spherical bearing assembly having a spherical portion and a sleeve, the sleeve surrounding at least a part of the spherical portion and being operatively coupled to the plate by engaging a wall of an aperture of the plate, said bearing assembly responsive to mechanical energy encountered by the binding or the snowboard during use by engaging the binding to pivot from or move along an axis orthogonal to a top surface of the snow board; and a biasing assembly biasing the plate away from the snowboard, said biasing assembly attached to said plate and oriented to press against the snowboard.

2. An apparatus in accordance with claim 1, wherein said plate includes a circular shaped hub portion having a flange engaging a circularly shaped surface, the circularly shaped surface being rotatable about the hub portion and the hub portion receiving the sleeve of said spherical bearing.

3. An apparatus in accordance with claim 2, wherein said hub portion includes at least one aperture into which said sleeve is mounted.

4. An apparatus in accordance with claim 2, wherein said hub further includes a plurality of apertures arranged in a pattern sutable for mounting the apparatus to a snowboard binding disc.

5. An apparatus in accordance with claim 2, wherein said hub includes a first surface having a first aperture, said circularly shaped surface includes a second surface having a second aperture, and the apparatus further comprises a locking member disposed within said first aperture and said second aperture.

6. An apparatus in accordance with claim 1, wherein said baising assembly includes a top portion and a bottom portion, said top and bottom portions threaded so as to engage one another and form a cavity in said biasing assembly, said cavity having a biasing element and a coupler disposed therein the coupler having an attachment portion protruding through said top portion and engaging said plate, the coupler biased by said biasing element away from said bottom portion.

7. An apparatus in accordance with claim 6, wherein said biasing assembly further includes a socket and a lid, said coupler having a swivel portion opposite said attachment portion encapsulated by said socket and said lid.

8. An apparatus in accordance with claim 6, wherein said top portion has a first end and a second end, said first end having an inner edge defining a first aperture and said second end having an inner edge defining a second aperture and said bottom portion has a first end having an inner edge defining a third aperture, wherein said first aperture is of a size allowing said coupler to a extend through said first end while of a size precluding said lid from extending through said first end, said second aperture is of a size allowing said coupler and said lid to extend through said second end, and said third aperture is of a size sufficient to receive said biasing element.

9. An apparatus in accordance with claim 8, wherein said bottom portion of said biasing assembly further includes an outer edge of a size sufficient to fit within said second aperture of said top portion.

10. An apparatus in accordance with claim 9, wherein said top portion further includes a threaded inner surface bounded by said second aperture and said bottom portion has a threaded outer surface bounded by said outer edge, said threaded inner surface interlocking with said threaded outer surface of said bottom portion.

11. An apparatus in accordance with claim 10, wherein said first end defines a maximum travel position for said lid.

12. An apparatus in accordance with claim 10, wherein said inner edge and said threaded inner surface and said interlocked threaded outer surface align the longitudinal axis of said top portion and said bottom portion.

13. An apparatus in accordance with claim 6, wherein said biasing element comprises at least one spiral spring having a rectangular-like cross-section.

14. An apparatus in accordance with claim 6, wherein said biasing assembly includes a biasing element which provides full compression at 52 pounds.

15. An apparatus in accordance with claim 6, wherein said coupler includes a swivel portion disposed opposite said attachment portion and said biasing assembly further includes a mating socket.

16. An apparatus in accordance with claim 15, further including a lid plate for covering said swivel portion.

* * * * *